US005360492A

United States Patent [19]

Gray

[11] Patent Number: 5,360,492

[45] Date of Patent: * Nov. 1, 1994

[54] PRETREATING COMPOSITION CONTAINING SUBSTITUTED TRIAZINE COMPOUND

[75] Inventor: Ralph C. Gray, Butler, Pa.

[73] Assignee: PPG Industries, Inc., Pittsburgh, Pa.

[ * ] Notice: The portion of the term of this patent subsequent to Sep. 22, 2009 has been disclaimed.

[21] Appl. No.: 864,287

[22] Filed: Apr. 6, 1992

Related U.S. Application Data

[60] Division of Ser. No. 739,579, Aug. 2, 1991, abandoned, which is a continuation-in-part of Ser. No. 426,355, Oct. 25, 1989, abandoned.

[51] Int. Cl.[5] ..... C23C 22/82

[52] U.S. Cl. ..... 148/255; 148/257

[58] Field of Search ..... 148/255, 257, 274; 106/14.15, 14.16

[56] References Cited

U.S. PATENT DOCUMENTS

| | | | |
|---|---|---|---|
| 2,898,250 | 8/1959 | Pimbley | 148/6.21 |
| 2,976,193 | 3/1961 | Pimbley | 148/6.21 |
| 3,043,716 | 7/1962 | Baesse | 156/244.11 |
| 5,149,382 | 9/1992 | Gray | 148/257 |

*Primary Examiner*—Sam Silverberg
*Attorney, Agent, or Firm*—William J. Uhl

[57] ABSTRACT

An aqueous pretreating composition for application to a metal surface, said composition having a pH of from about 3.4 to about 6, comprising at least about 0.01 percent by weight based the total weight of the composition of a substituted triazine compound selected from compounds having the structures:

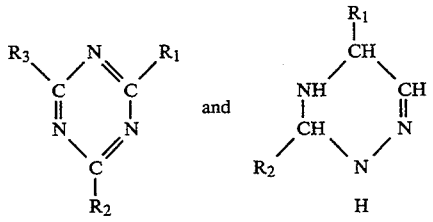

wherein $R_1$ and $R_2$ and, where applicable, $R_3$ are the same or different and are selected from the group consisting of —OH, —SH, —$NH_2$, =O, an allyloxy group having 3–8 carbon atoms and a carboxy alkyl group having 2–8 carbon atoms.

12 Claims, No Drawings

PRETREATING COMPOSITION CONTAINING SUBSTITUTED TRIAZINE COMPOUND

CROSS-REFERENCE TO RELATED APPLICATION

This is a division of application Ser. No. 07/739,579, filed Aug. 2, 1991, now abandoned, which is a continuation-in-part of application Ser. No. 07/426,355, filed Oct. 25, 1989, now abandoned.

BACKGROUND OF THE INVENTION

1. Field of the Invention

The present invention relates to a pretreatment composition which is free of chromic acid; said composition is particularly useful as a final rinse in a metal pretreatment process.

2. Brief Description of the Prior Art

In the metal pretreatment process, it is known to employ a phosphating conversion coating which is usually followed by a final rinsing or sealing step. The rinsing composition usually comprises chromic acid. While effective in the rinsing step, chromic acid is, nonetheless, undesirable because of its toxicity and the attendant problems of disposal.

Hence, considerable work has been done in finding a replacement for chromic acid in the final rinsing step. The present invention provides a pretreatment composition which is essentially free of chromic acid.

SUMMARY OF THE INVENTION

In accordance with the foregoing, the present invention encompasses an aqueous composition comprising a substituted triazine compound selected from those having the structures:

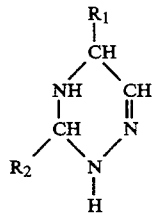

wherein $R_1$ and $R_2$ and, where applicable, $R_3$ are the same or different and are selected from the group consisting of —OH, —SH, —$NH_2$, =O, an allyloxy group having 3–8 carbon atoms and a carboxy alkyl group having 2–8 carbon atoms. These compounds (hereinafter referred to as the "substituted triazine compounds") are adapted for use for pretreating a ferrous or non-ferrous metal surface. The aqueous composition of the substituted triazine compounds contains at least about 0.01 percent by weight or higher of the substituted triazine compound based on the total weight of the composition, at a pH of about 3.4 to 6 and a temperature range of about 30° C. to 80° C.

The invention further encompasses a process of pretreating a metal surface comprising applying an effective aqueous composition of the substituted triazine compounds to the metal surface to produce a corrosion resistant surface that can adhere to a subsequently applied coating. Preferably, the aqueous compositions of the substituted triazine compounds are employed as a final rinse over a metal surface comprising a conversion coating such as a phosphate conversion coating.

DETAILED DESCRIPTION OF THE INVENTION

The useful substituted triazine compound must be compatible with an aqueous medium, i.e., it is mixable to produce an effective aqueous composition that can be applied to a substrate to produce a corrosion resistant surface that can adhere to a subsequently applied coating. Typically, it must have solubility of at least about 0.01 gram per 100 grams of water at 25° C. The aqueous composition of this invention can be prepared by mixing the substituted triazine compound with an aqueous medium, preferably at a temperature of about 30° C. to 80° C. and more preferably about 40° C. to 60° C. By an aqueous medium is meant water or water in combination with an adjuvant that can enhance the solubility of the substituted triazine compound. The aqueous composition may also contain an additive such as a pH buffer, phosphate, borate, potassium salt or the like or a mixture thereof.

Accordingly, the aqueous pretreating composition of this invention can have a pH of about 3.4 to 6 and preferably about 4.0 to 5.0. The composition can contain about 0.01 to 1.0 percent by weight and preferably about 0.05 to 0.15 percent by weight of the substituted triazine compound based on the total weight of the composition. While higher amounts of the substituted triazine compound can be employed in the aqueous composition, it does not appear that there is an improvement in performance of such a composition. However, under certain circumstances, the higher concentration in the form of a concentrate may be desirable, for reasons such as ease of handling.

The aqueous composition of the substituted triazine compound is applied under conditions that produce a corrosion-resistant barrier which is receptive to a subsequent coating process such as a conventional coating or electrocoating. The temperature of the aqueous composition at which a substrate is treated therewith is typically from about 30° C. to 80° C. and preferably about 40° C. to 60° C. The pH of the treating composition during application is typically about 3.5 to 6 and preferably about 4 to 5.0.

In the process of this invention, the aqueous composition of the substituted triazine compound is employed in treating a ferrous or non-ferrous metal such as cold rolled steel, galvanized steel or the like. Preferably, the aqueous composition is applied to a metal surface comprising a conversion coating such as a phosphated conversion coating; a zinc phosphate conversion coating is preferred herein. The aqueous composition containing the substituted triazine compound is applied to the metal surface by spraying, immersion or any other convenient means. After the aqueous composition has been applied, the metal is usually rinsed with deionized water and then coated with a surface coating, usually after it has been dried.

In a typical pretreatment process, the metal to be treated is cleaned by a physical or chemical means and water rinsed in order to remove surface contamination such as grease or dirt. The metal surface is then brought into contact with a conversion coating composition, rinsed with water and then rinsed with the composition of this invention. After the application of the aqueous solution of the substituted triazine compound with rinsing and drying, the ferrous or non-ferrous metal can be coated by any convenient means. It has been found that the pretreatment process of the metal with the aqueous composition of the substituted triazine compound imparts to the coated substrate improved adhesion and corrosion resistance properties.

The invention is further illustrated by the following non-limiting examples.

EXAMPLE 1

Hot dipped galvanized steel panels were phosphated with CHEMFOS 168 zinc nickel phosphating solution (from Chemfil Corporation) at an average coating weight of 210 mg/ft$^2$. The panels and then immersed for 60 seconds in aqueous solutions of substituted triazine compounds shown in Table I at 120° F. The concentrations and pHs of these substituted triazine compounds in city water are also shown in Table I. The panels were dried with a warm air blower and primed the same day with 3150 UNI-PRIME electrodeposition primer (from PPG Industries, Inc., herein "PPG") at about 275 volts giving about 1.2 mils dry film thickness. The panels were subsequently top coated with HUBC white basecoat (from PPG) at about 0.7 mil and then with URC 1000 clearcoat (from PPG) at about 1.7 mils. The panels were then prepared for testing by scribing and abrading with steel shot according to the "CHRYSLER" chipping scab test procedure, as follows.

1) 4"×12" test panels were coated as described above.
2) The top half of the panel was scribed with a 12 cm (4.7") "X" scribe. A strip of pull tape was firmly applied to one side of the "X" and removed in a rapid vertical motion. Repeat of this procedure was conducted with the other side of the "X".
3) The air pressure of the gravelometer (from Ford) was adjusted to 205 kPa (30 psi).
4) The air valve of the gravelometer was shut off and 200 ml (32 oz.) of steel shot was collected.
5) A test panel was placed in the panel holder with the coated side facing the gravel projecting mechanism of the gravelometer. The lid of the test chamber was then closed.
6) The air valve was opened to let the pressure stabilize. Two hundred milliliters (200 ml) (32 oz.) of shot was poured into the hopper. The air was turned off when all of the shot had been spent.
7) The panel was placed in 5 percent salt solution (pH of about 6.6 to 7.1) for a minimum of 15 minutes.
8) The panel was removed and allowed to recover at lab conditions for 1 hour and 15 minutes and then placed in humidity cabinet for 22.5 hours.

An "accelerated" test was conducted as follows:

a) The humidity cabinet was set at 85 percent relative humidity and 60° C. (140° F.).
b) A cycle program as outlined in steps 7 to 8 was run over a period of 24 hours.
c) Thereafter (on the next day), the panel was removed from the humidity cabinet and within 30 minutes, steps 3 to 8, as set forth above, were followed.
d) At the conclusion of a 23-day cycle of steps a–c (after step 6), the panels were washed with sponge and water (a mild detergent could be used). Excess water was removed and the panel(s) were allowed to recover for 30 minutes.
e) The target area was covered with pull tape and removed as outlined in step 2.
f) The percent paint loss in the target area was estimated.

CONTROL: Control panels were also prepared with CHEMSEAL 20 chrome rinse (from Chemfil Corporation) and with a deionized water rinse for comparison purposes. Triplicate panels were prepared for each system and subjected to the same CHRYSLER chipping scale test as described above. The panels were evaluated according to the amount of paint removed by taping with #898 3M SCOTCH tape after the test period. The results of the tests are reported in Table I hereinbelow.

TABLE I

| Rinse | Paint Adhesion Loss |
|---|---|
| Deionized water | 24% |
| CHEMSEAL 20 | 2% |
| .1% aqueous composition of cyanuric acid | 3% |
| .1% aqueous composition of trithiocyanuric acid | 6% |
| .1% aqueous composition of 6, azauracil | 5% |
| .1% aqueous composition of melamine | 6% |
| .1% aqueous composition of 2,4,6-triallyloxy-1,3,5-triazine | 4% |
| .1% aqueous composition of carboxymethyl cyanuric acid | 6% |

What is claimed is:

1. A process for pretreating ferrous or galvanized a metal surface prior to painting comprising contacting said metal surface, to which a crystalline zinc phosphate conversion coating has been previously applied, with an aqueous composition of a substituted triazine compound selected from compounds having the structure:

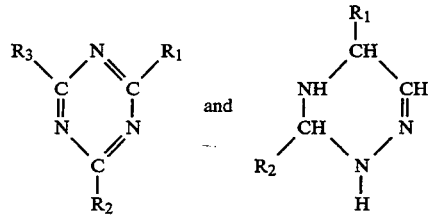

wherein $R_1$ and $R_2$ and, where applicable, $R_3$ are the same or different and are selected from the group consisting of —OH, —SH, —$NH_2$, an allyloxy group having 3–8 carbon atoms and a carboxy alkyl group having 2–8 carbon atoms; said aqueous composition having a concentration of at least 0.01 percent by weight of said triazine compound based on total weight of said aqueous composition.

2. The process of claim 1 in which the concentration of said triazine compound is from 0.01 to 1 percent by weight.

3. The process of claim 1 in which the aqueous composition has a pH of about 3.4 to about 6.0.

4. The process of claim 1 in which the aqueous composition is at a temperature of about 30° C. to about 80° C.

5. The process of claim 1 wherein the substituted triazine compound is selected from the group consisting of trithiocyanuric acid, 6-azauridine, melamine, carboxymethyl cyanuric acid and triallyloxycyanurate.

6. The process of claim 1 wherein the substituted triazine compound is cyanuric acid.

7. The process of claim 1 which comprises an additional step of applying a surface coating to the metal substrate which has been previously contacted with said aqueous composition.

8. The process of claim 7 in which the surface coating is applied by electrodeposition.

9. A process for pretreating ferrous or galvanized a metal surface prior to painting comprising:

(a) applying a crystalline zinc phosphate conversion coating to said metal substrate, followed by (b) contacting said metal surface, with the applied zinc phosphate conversion coating, with an aqueous composition of a substituted triazine compound selected from compounds having the structure:

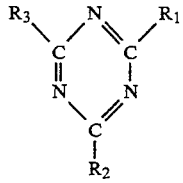

and

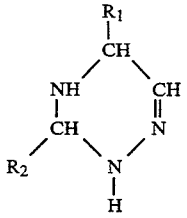

wherein $R_1$ and $R_2$ and, where applicable, $R_3$ are the same or different and are selected from the group consisting of —OH, —SH, —$NH_2$, an allyloxy group having 3–8 carbon atoms and a carboxy alkyl group having 2–8 carbon atoms; said aqueous composition having a concentration of at least 0.01 percent by weight of said triazine compound based on total weight of said aqueous composition, (c) applying a surface coating to the metal substrate which has been previously contacted with said aqueous composition.

10. The process of claim 9 in which the substituted triazine compound is present in the aqueous concentration in amounts from 0.01 to 1 percent by weight.

11. The process of claim 9 in which the substituted triazine compound is cyanuric acid.

12. The process of claim 9 in which the surface coating is applied by electrodeposition.

* * * * *

UNITED STATES PATENT AND TRADEMARK OFFICE

CERTIFICATE OF CORRECTION

PATENT NO. : 5,360,492

DATED : November 1, 1994

INVENTOR(S) : Gray

It is certified that error appears in the above-identified patent and that said Letters Patent is hereby corrected as shown below:

Claim 1, line 1: insert the term --a-- before the word "ferrous" and delete the term "a" after the word "galvanized".

Claim 9, line 1: insert the term --a-- before the word "ferrous" and delete the term "a" after the word "galvanized".

In the Abstract: line 4, insert the word --on-- after the word "based".

Signed and Sealed this

Second Day of September, 1997

*Attest:*

Bruce Lehman

BRUCE LEHMAN

*Attesting Officer*

*Commissioner of Patents and Trademarks*